United States Patent [19]

Gubela

[11] 3,973,342

[45] Aug. 10, 1976

[54] LIGHT REFLECTOR PLATE AND METHOD OF FABRICATION

[76] Inventor: Hans-Erich Gubela, Hundeberg 41K, 7595 Sasbachwalden, Germany, 7595

[22] Filed: Apr. 18, 1972

[21] Appl. No.: 245,207

[30] Foreign Application Priority Data

Apr. 19, 1971 Germany ..... 2118822

[52] U.S. Cl. ..... 40/136; 40/125 N

[51] Int. Cl.[2] ..... G09F 13/16

[58] Field of Search ..... 40/125 N, 130 B, 130 S, 40/135, 208, 136, 133 R, 129 C; 350/97, 103, 106

[56] References Cited

UNITED STATES PATENTS

| | | | |
|---|---|---|---|
| 1,688,196 | 10/1928 | Masson | 40/135 |
| 1,846,173 | 2/1932 | Willweischeid | 40/135 |
| 1,856,462 | 5/1932 | Burns | 40/130 B UX |
| 1,858,975 | 5/1932 | Ta'Bois | 40/130 B |
| 1,990,224 | 2/1935 | Cochran | 40/136 |
| 2,003,126 | 5/1935 | Torstenson | 40/135 X |
| 2,016,333 | 10/1935 | Leeds | 40/135 |
| 2,037,773 | 4/1936 | Eynon | 40/208 X |
| 2,193,057 | 3/1940 | Carver | 40/135 |
| 2,294,930 | 9/1942 | Palmquist | 40/135 X |
| 3,096,596 | 7/1963 | Magnuson et al. | 40/135 |
| 3,632,695 | 1/1972 | Howell | 350/103 X |

*Primary Examiner*—John F. Pitrelli
*Attorney, Agent, or Firm*—P. D. Golrick

[57] ABSTRACT

A reflector plate including a transparent or at least translucent synthetic plastic body with a back surface having a multiplicity of evenly distributed, integral, optically precisely formed triangular pyramids or like prisms as reflecting element formations and covered with a reflective metallic layer, for example, silver, aluminum, copper, chromium or nickel, has front surface differentiation for symbols such as letters or numbers provided by impressing to indent or raise surface portions, or material application. An auto license plate, not alterable without ready detection, is a particularly advantageous disclosed use. A method of fabrication including injection molding, casting molding, or hot or cold forming of a plastic body with the back-reflecting prism formations with steps for applying or incorporating the symbols, and certain apparatus therefor are outlined.

4 Claims, 17 Drawing Figures

FIG. 1
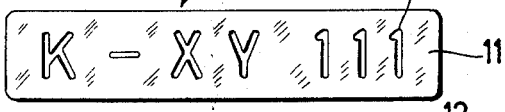
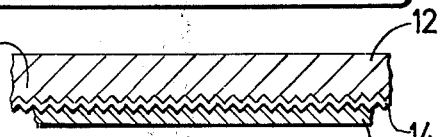
FIG. 2
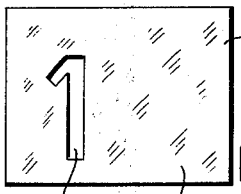
FIG. 3
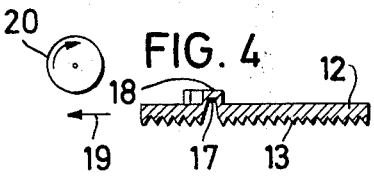
FIG. 4
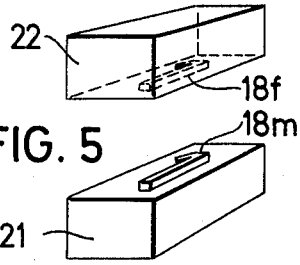
FIG. 5
FIG. 6
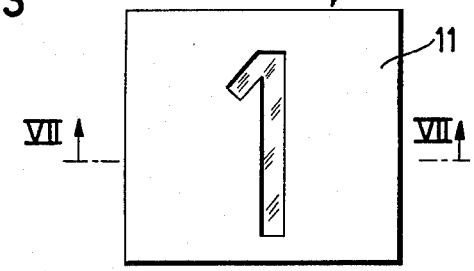
FIG. 7
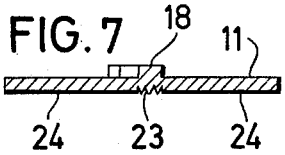
FIG. 11
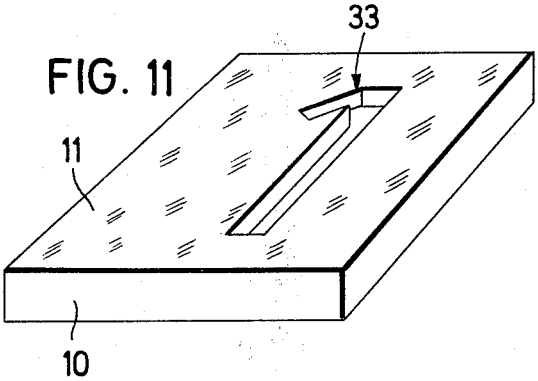
FIG. 9
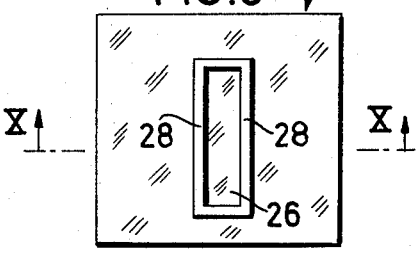
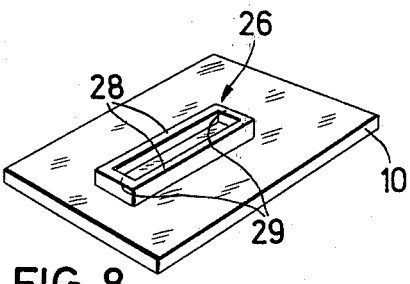
FIG. 8
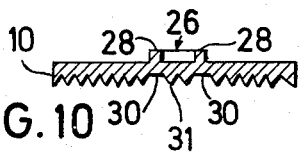
FIG. 10

LIGHT REFLECTOR PLATE AND METHOD OF FABRICATION

As conducive to safety for night driving, there are already known and in use reflective traffic signs comprised of metal sheet overlayed with a reflective film constituted of a plural layered synthetic plastic structure with embedded fine glass beads which shine when illuminated by automobile head lights.

It would be desirable that automobiles also be provided with reflective plates, so that they would be visible even from a distance in night highway traffic, and particularly desirable that the license plates be made reflective so that at night a vehicle would be recognizable by its license plates when illuminated. The license plates hitherto known, at least in many areas, are non-reflective, generally being comprised of a lacquered metal plate of sheet iron, aluminum and the like, with the symbols, letters and/or numbers, stamped into relief, and with the raised surfaces finally lacquered in another color, in general of a dark color tone.

The basic object of the invention is to provide a back-reflecting surface and a plate which serves for improving safety in night highway traffic, as well as making for better perception of the traffic right of way and of traffic directing devices as well as of the vehicles.

It is a further object of the invention to provide a method of fabrication of such reflective surfaces and plates.

In accordance with the invention, the back-reflecting surfaces and plates are comprised of a reflector plate which is characterized by the fact that it has a synthetic plastic plate body of which the front or viewed surface is generally smooth, and that the back side, which is provided with optically precisely formed back-reflecting elements as triangular pyramids, prisms, or the like, is coated with a reflective layer, for example, of silver, aluminum, copper, chromium or nickel; and in this body plate there are impressed or surface extruded or applied on its front surface, symbols such as letters or numbers. However, other prisms systems can also be used for the light reflection.

In accordance with a particular embodiment of the inventive concept, the reflector plate of the invention is used as a license plate for automotive vehicles, with the symbols having another color than the rest of the plate.

In accordance with an essential characteristic of the invention as so used, the symbols can be raised into relief from the front or viewed surface of the reflector plate. When a reflective license plate is manufactured in this manner, one previously manufacturing license plates of the hitherto known type, requires no new stamping press machine, and he need not modify his basic mode of stamping and further processing of the license plates, because the reflective plates of the invention basically are stamped or impressed essentially as known aluminum or metallic plates are stamped, so that the impressed symbols are raised or project above the general surface of the reflector, and finally are as a rule lacquered with a black lacquer coating.

However, if the symbols, for example, should have to be stencilled with lacquer or cemented on the basic reflective plate of the invention, then in such cases new fabrication procedures and tooling would be necessary for the license plate manufacture.

In the pressing or stamping of the reflector plate of the invention, the prisms disposed behind the relief-formed symbol are crushed, so that the raised symbols are no longer reflective. In a license plate, this plays no part in respect to the basic reflective capability, since the relief-formed symbols are, of course, each lacquered on the surface with a coloring cover.

The stamping or impression of symbols in the inventive reflector plate can also be so effected that the prisms disposed behind the symbols are not crushed, but rather the rest of the symbols of the reflector plate are crushed in which case then only the symbols can be reflective.

By this invention, it is also possible to impress the symbols into the front or viewed surface in such manner that the front surface is in effect raised about the symbols or characters. By a further advantageous feature, only the margins or borders of the symbols can be indented or expressed in or from the front surface; and then during the pressing or stamping, only those prisms are crushed which lay in the region of the symbol margins; so that, though the margins are non-reflective, the major part of the symbol, where the prisms are maintained, is reflective.

With a license plate, the crushing of the back prisms during stamping or pressing of the symbols in the reflective plate of the invention actually has a great advantage over prior license plates. For with the latter, the impression of the lacquered metal sheet can be again pressed back through suitable tools without leaving any marked traces of the falsification. In contrast, with the reflector plate of invention, this is not the case, since a pattern of crushed and uncrushed prisms in every case arises corresponding to the original symbols, and any flattening of the material to alter the symbols, even with impressions of new symbols, is evident through the change in reflective characteristics at the location of the original pattern.

A license plate fabricated from a reflective plate of the invention therefore absolutely cannot be effectively falsified, since the impressed symbols can not be altered without leaving behind a clear evidence thereof. If a symbol is pressed or hammered back flat, location and the shape of the symbol is always recognizable through these crushed prisms since at these locations the prisms are not reflective. A license plate falsification also would be recognizable, even if at the same location another symbol were to be impressed, since the latter would not be precisely coincident in shape with the previous symbol.

By another aspect of the invention to protect the chemically, electrolytically or vapor deposited reflective metallic mirror layer, a lacquer or synthetic plastic layer can be applied to the metal back surface by painting, injection molding or spraying or foaming operations and conforming to the contour of the underlying prisms on the back side.

After the plastic body plate is provided with the silvered or other mirroring surface it can also be protected by a plastic backing plate cemented or welded thereto, which either again conforms to the prismed back surface of the body but has itself a flat back surface, or can, be flat on both faces.

As the body plate itself is comprised of a glass-clear transparent material, to give it in daytime a white background appearance, by another aspect of the invention, the plastic material can be through-colored milk-white. To decrease the plate reflective power, the plastic material can be made cloudy through a uniform coloring, and accordingly be made less transparent to light.

For the example of the license plate, to make the nonraised front surface appear white-colored in daylight, it can be imprinted with a multiplicity of white dots in a grid or screen pattern. In such case the grid is so made, provided, that a respectively pre-determined part of the reflecting light is permitted to pass through. If the grid is made of a non-transparent covering pigment, the reflected light therefore does not take on the color of the grid, because it only penetrates the interstices of the grid. The coloring of the reflector plate and the color of the grid can be so chosen, that in daytime the front surface corresponds in color to the grid or is so perceived by the eye, while in contrast, at night the color of the reflecting area appears to correspond to the coloration of the synthetic plastic body material. For example, the reflecting area therefore can be so made that by day it appears to be black and at night as white.

By a further characteristic of the invention, for a color-differentiation of the symbols from the rest of the plate front surface, one of these areas made be, covered by a transparent lacquer correspondingly coloring the reflected light. By this approach, the symbols reflect in another color than the remainder of the reflecting surface, because the lacquer, colored say red, permits only that light frequency range or wave length range to pass through which gives red, and all other wave lengths are filtered out.

The reflector plate can also be injection molded from already colored material and transparent lacquering then so selected that it produces a further color; and by applying one or more appropriate coloring layers on the colored reflector body all color tones can be attained next to one another similarly to four-color printing.

The fabrication method of the inventive reflective plate comprises producing the body plate provided with the prisms of a light-transparent and impact-resistant synthetic plastic, by injection molding, vacuum casting, cold-forming or hot-forming; after which the back side of the plate is "silvered", i.e. reflectively coated with a metallic layer, silver or other suitable metal, and as may be required, then covered by a protective second plastic layer or plate; whereafter the symbols are impressed in or raised out of the reflective plate stock. If only the outlines, i.e., peripheries or margins of the symbols are to appear raised or in relief, then these margins are raised out of the plate flat front surface by a corresponding hollow or recessed tool or stamp. The raised faces or surfaces of the symbols margins projecting out of the front surface of the plate body, are finally lacquered in a preferably black or dark color tone with a roller. As noted, during stamping of the symbols either the prisms laying behind the symbols or all the other prisms of the reflector plate are crushed flat depending upon how the symbols are formed.

The reflector plate stock can have the entire front surface covered by a layer of colored lacquer or other material; and, after symbols are formed in relief projecting above the front plate face, by simple means the color layer can be ground off the raised symbols, leaving it intact over the rest of the non-raised plate surface. Such a color layer can be comprised of the most diverse materials, such as lacquer, films, synthetic plastic and the like; and can also be applied in the injection molding procedure or can be inserted as a plastic plate in the injection mold for the reflector.

To provide color contrast between the stamped and the non-stamped reflecting surfaces, the colored layers or symbols can be prepared by the injection molding process from like or similar plastics (transparent or non-transparent) or as stamped out plates (foils and so forth) which can be layed in the injection mold or can be subsequently cemented on the reflector body. The manufacture can also be carried out by inserting the reflector plate in the mold tooling for the colorsymbols to be injection molded of plastic.

For all the above described transparent or concealing color lacquerings on the body plate front surface, there can also be substituted an imprinted transparent film, which is cemented on the front surface or, for example, with injection molding of the plate, is inserted in the mold, so that it bonds itself with the synthetic plastic material at the reflector top surface.

The invention is hereinafter described in greater detail with respect to examples of the article and method aspects of the invention schematically represented in the figures of the drawings.

Other objects and advantages of the invention will appear from the following description and the drawings wherein:

FIG. 1 is a generalized front view of a reflector plate of the invention embodied in a reflector license plate for an automotive vehicle;

FIG. 2 is a cross-section showing the structure of a reflector plate of the invention;

FIG. 3 is a fragmentary front view of the reflector plate with numeral produced with the tool device of FIG. 5;

FIG. 4 is a cross-section taken along the line IV—IV in FIG. 3;

FIG. 5 is a device for impressing the numeral in the reflector plate;

FIG. 6 is a fragmentary view of another reflector plate and symbol form;

FIG. 7 is a cross-section taken along the line VII—VII in FIG. 6;

FIGS. 8 and 9 are respectively perspective and plan views of a plate showing further modification of the symbol delineation form;

FIG. 10 is a section taken along line X—X in FIG. 9;

FIG. 11 is a perspective view of a further modification embodiment of the invention as to a numeral impressed in the plate;

Figure 16:
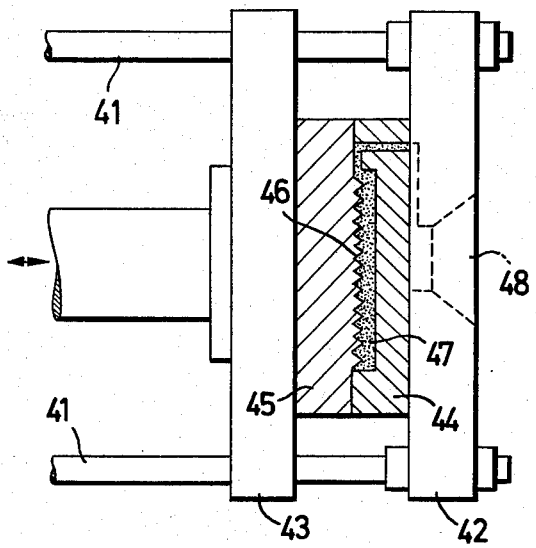
Figure 17:
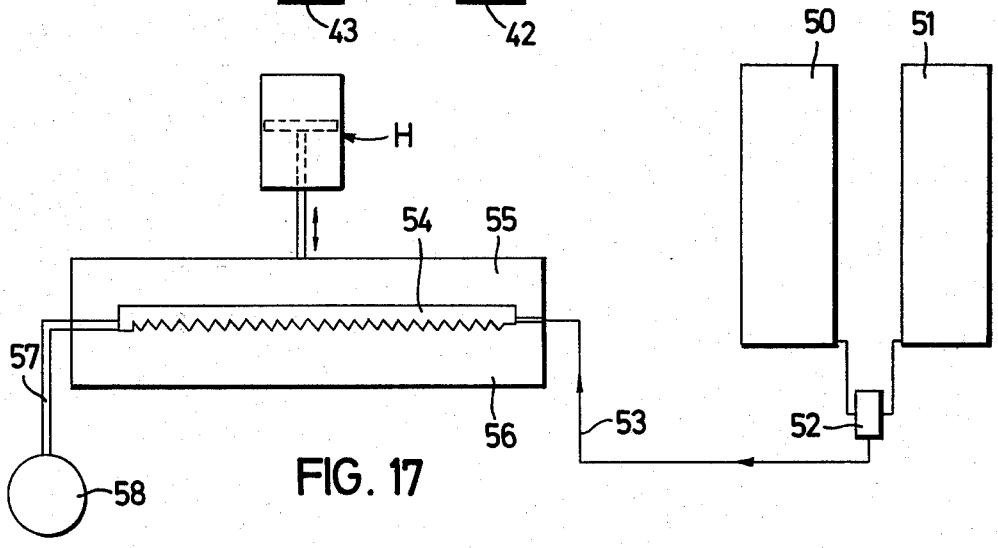

FIG. 16, partially in elevation and partially in section, shows an injection molding press for manufacture of a plastic body plate; and FIG. 17 is a device for two-component mold casting of a synthetic plastic body plate under vacuum.

Among the drawings, FIG. 1 shows an automotive vehicle license plate as a useful application and embodiment of a reflective plate structure 10 of the invention, on the front face 11 of which, that is the viewed side exposed to incident light, there are delineated symbols, here letters and numerals, such as the numeral 1 designated by the reference numeral 18. However, it is to be understood that the inventive concept here disclosed has application in other fields where a light reflective plate, especially a symbol-bearing plate, is desired. The symbols 18 may be delineated, for visibility when viewed from the front, in various ways as hereinafter explained.

The basic reflector plate structure 19 (see FIG. 2) comprises a body plate 12, generally flat and smooth on its front face 11, and having over its entire back face, or over a substantial part thereof corresponding to a body plate area occupied by or especially useful for delineation of symbols, a uniformly distributed, integrally, optically-precision formed array or multiplicity 13 of prisms; a reflective metal layer or coating 14 over at least the prism bearing area on the back side; and at times a protective coating or layer 15 where the latter is required by the nature of the metal in 14 and the conditions of the reflector plate use. Also a further coating or layer 16 may be present (see FIG. 12) as will be explained.

The prisms may have the form of triangular pyramids, or other prism forms disposed and adapted to reflect light effectively, preferably with some diffusion, back in the general direction from which it is incident upon the plate; and as to these, this is the primary intent of the characterization "optically precisely formed" or like terminology herein used.

By "integral" as characterizing the prisms, the intent is that they are formed of the same material as, and represent continuous structure with, the main mass of the material of which the body 12 is constituted. The body material may be comprised of any one of many now available, obviously preferably impact-resistant, synthetic plastics; and is transparent to light or at least highly translucent. The metal of the reflective layer 14 may be, for example, silver, chromium, aluminum, copper, or nickel as common commercially used metals, applied by chemical, electrolytic, vapor or sputtering or other process appropriate to the metal, the body material, possible specification requirements and other factors determining such choice.

One form of symbol and the manner of producing it in a plate stock already having the prisms formed thereon and metallized with the reflective layer (such as plate being hereinafter referred to as, and intended by "body plate stock" unless otherwise qualified) is represented in FIG. 3–5. Here (see especially FIG. 3) the symbol 18 (the numeral 1 ) appears on the plate front side in relief, raised above the surrounding front face area 11; that is, the flat front surface of symbol 18 is offset upward above the plane of the rest of the plate face 11. Accordingly, the plate having such a symbol in relief, or several such symbols, is adapted (see FIG. 4) to be passed in the direction of arrow 19 under an appropriately driven and coating material-supplied coating or coloring roller 20 which, similarly to the ink applying action of the form roller in a printing press, applies a lacquer or other pigmented coating, preferably opaque and black in this case, to the upwardly offset faces of the symbol configurations.

The individual symbols are thus formed or embossed by a pair of complementary dies, such as the punch-like and matrix-like tool elements 21, 22 having respectively the cooperating male and female outlines **18*m*, 18*f***, of the symbol, (the numeral 1 ) to engage the back and front sides of the blank of body plate stock to be symbol-embossed; appropriate die holding means being of course employed for the die pair or pairs.

For greater contrast especially by day the plastic of the body plate may be somewhat pigmented, e.g., milky white, while retaining adequate reflectivity.

As is evident from section FIG. 4, where the total body plate elements are not shown, at the location of the recess 17 formed by the punch male symbol configuration **18*m*, the prisms of the array 13** flattened into the body are obliterated, so that the area of the symbol configuration is no longer markedly reflective. Accordingly the areas with the intact and obliterated prisms are in this limited sense termed respectively reflective and non-reflective.

Since the symbol in any event is to be clearly differentiated from the plate background and even by the application of an opaque or black covering coating on its face, this non-reflectivity is of no consequence in the primary function of the reflector plate; but on the other hand, since the prisms underlying the original symbol are thus crushed to non-reflectivity, if the original symbol is altered even by flattening it out, the alteration is readily detectable because of its persisting non-reflectivity pattern.

Figure 12:
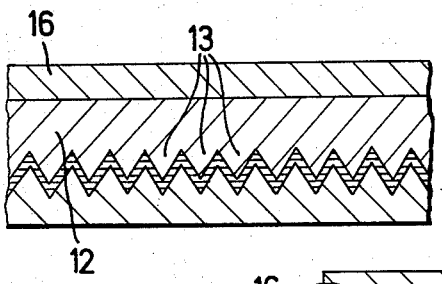
FIG. 12 is a section taken along through a further example of the reflector plate structure.

Other formations of symbols in relief are represented in FIGS. 6 to 10 inclusive and FIG. 12. In FIGS. 6–7, the symbol 18, appearing as the numeral 1 is again raised in relief with a solid numeral face surface, but conversely to the situation in FIGS. 3 and 4, here in the portion 23 of the prism array lying immediately behind the area of the symbol, the prisms are not crushed while those in the region 24 surrounding the area 23 are flattened and totally obliterated, so that as to the area occupied by the symbol and at least an appreciable surrounding area 24 only that of the symbol itself retains the marked original reflectivity, so that in the above noted sense they are respectively non-reflecting and reflecting.

In FIGS. 8–10, a vertical bar or elongated rectangular symbol 26, for example, a block form I or numeral 1, is delineated on the front face 11 of plate 10, by a recessed stamp engaging the front plate face and raising or embossing the plate material in such fashion that only the parallel side and top edge ridges 28 and 29 (with widths on the order of say 1 to 2 mm) are in relief providing the outline of the symbol, the major expanse of which is not elevated. From FIG. 10 it is apparent that only those areas of the prism, array, e.g., at 30, which underlie the parts of the front face in relief, are crushed or flattened and hence non-reflecting; the part 31 underlying the major symbol area as well as the rest of the back area outside symbol-occupied area being intact and hence remaining reflective.

A reflective plate 10 is illustrated in FIG. 11 with the symbol 33 presented in an intaglio-like form indented or impressed down into the plate below the plate front face surface 11; in which case, the symbol itself may be non-reflective if the indenting stamp is opposed by a flat faced co-operating tool or conversely, reflective with a recessed matrix element opposing.

Figure 13:
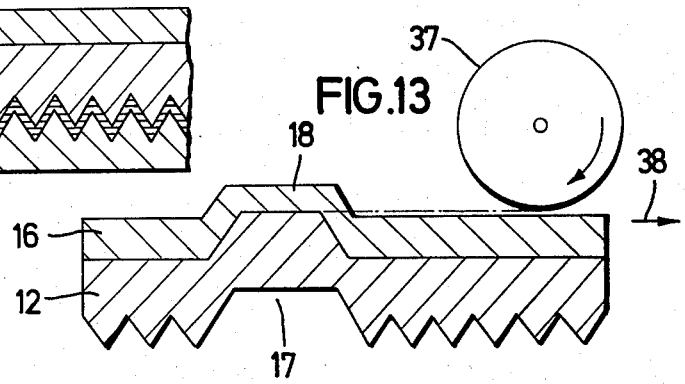
FIG. 13 shows reflector plate stock of FIG. 12 after a subsequent impression delineation of a symbol and during further operations upon the plate front surface.

A modification in the body plate stock is presented in FIG. 12, in which the entire plate body front face area is covered by a layer 16 having a coloration differing from that of the material in body 12 and comprised of a coating lacquer, a film or other synthetic plastic material applied to the basic plate 12, during or after the casting or injection molding production of the latter. If this modified body plate stock is embossed or provided with symbols in relief as at 18 in FIG. 13, for example, generally in the manner shown and described for FIGS. 3, 4, and 5, in place of roller application of colored facing to the symbol front as represented in FIG. 4 to obtain marked color differentiation, here the symbol-embossed plate is passed in the direction of arrow 38 under a rotating grinding disk or cylinder 37 which is set to grind off only that portion of the layer 16 on, and down to, the upwardly offset face of the body material 12 of the symbol configuration. Thus by virtue of the difference in coloration of the layer 16 and the body 12, as well as the obliteration of the prisms at the region 17 below the symbol, there is both color and reflectivity differentation of the symbols and the main body area as a background.

Figure 14:
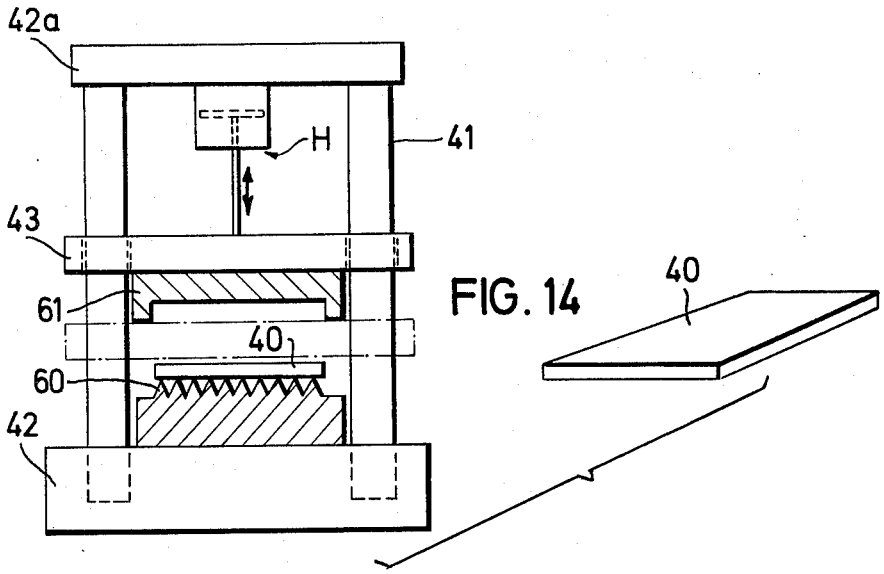
FIG. 14 shows schematically an apparatus involved in cold-forming of the synthetic plastic body plate.
Figure 15:
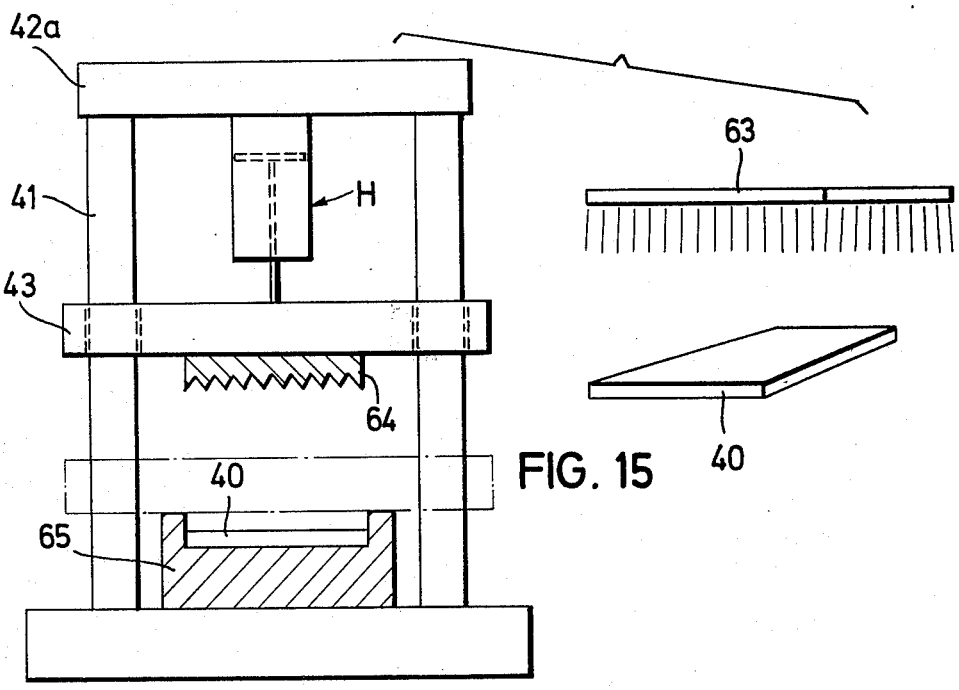
FIG. 15 shows schematically an apparatus for hot-forming of the synthetic plastic body plate.

In FIGS. 14 and 15 there are represented respectively cold forming and hot forming operations for production of plate body elements with the back side reflective prism arrays, such as the body portions 12 of the previous figures, starting with a bilaterally flat rectangular blank 40 of suitable cold flowable or extrudable, or thermoplastic material, having appropriate dimensions and other requisite or desired properties. Both figures represent in a generalized form a molding press in which guide posts 41, extending between a platen or mold mounting bed plate 42 and a head plate 42*a*, slideably support a moving platen 43 reciprocated by an hydraulic cylinder unit H to raise and lower a moveable mold or die half relative to a co-operating fixed mold half.

For the cold forming, the blank 40 in FIG. 14 is placed upon the fixed die block 60, there appearing as a stamp provided with a top surface configuration contoured complementary to the desired prism array configuration; and the press is closed bringing the matrix or recessed type upper mold block 61 down into co-operative engagement with the lower part 60 and so capturing and cold forming the blank material to the desired form.

For the hot forming as in FIG. 15, the blank 40 is first subjected to softening heat from the radiant heater 63, and then is placed in the recessed bottom mold half 65; wherein, upon descent of the co-operating upper stamp - like mold half 64 having a bottom surface contoured for prism array molding (as in 60 previously described), the captive blank is hot formed under pressure of 64 thermoplasticially to the desired body shape.

In FIG. 16, there is represented in fragmentary and generalized form the molding end of an injection molding press; elements analogous to those of FIGS. 14–15 being designated by similar reference numerals, though representing a distinct type of apparatus in which the parts are arranged for the conventional horizontal relative reciprocation. Here, of course, the movable mold half 45 on the shiftable carrier 43, bearing the prism array producing patterning 46, is closed upon the recessed, body plate outline determining, fixed mold part 44 to define the mold cavity, empty at the start of a cycle. This cavity is filled with the injection molding composition by a conventional injection molding shot cylinder (not shown), the nozzle of which is received in the mating central recess 48 of end plate 42 to feed the composition through channels in plate 42 and mold 44 as shown into the cavity to be molded into the body plate element 47.

In FIG. 17, there is schematically represented an equipment for casting a body plate element 12 with the described prism array from a synthetic plastic resulting from a two-component reaction mixture. The two-components are fed from supply source vessels 50, 51 through a mixing head 52 delivering the reactant mix via line 53 under appropriate pressure to the prismed plate molding cavity 54 defined between the mold halves 55–56, somewhat similar to 44, 46 in FIG. 16, but supported say in a press structure like that of FIGS. 14–15 so that mold half 55 may be moved toward and away from 56 by operation of the hydraulic or pneumatic cylinder H. Conventionally, at a point remote from the entrance of line 53, a vacuum line 57 connects vacuum pump 58 to the cavity to exhaust air and vapor therefrom and thereby ensure the necessary rapid and complete filling of the cavity with the reacting mixture.

The above description omits conventional minor cycle steps, apparatus elements and their operations, such as the cycle details of press running, cycle timing, mold opening and closing, finished piece knock-outs and product clean-up for sprue and mold marks, mold cooling and the like, as known and obvious in that art and not part of the characterizing aspects of the invention.

The body plate elements 12 can be produced, by any of the aforedescribed or similar operations appropriate to the plastic material required or desired, as individual units, as it were tailored for the finished products reflector plates desired, or cut to size from larger prismed sheets. The prismed plates are "silvered" or metallized, that is, provided with the reflective metal layer 14 of the desired metal, by conventional procedures as previously mentioned; and though the prismed plastic material may be made in larger sheets, usually preferrably the metallizing is done after cutting to smaller size for handling convenience and ease of control of metallizing operations in smaller equipments.

The protective layer 15 when used, whether lacquer or a bonded-on plastic film, may be applied to the metallized body stock before the embossing or other formation of the symbols; and may have the form of a foamed on layer or of a thinner plate flat on both sides cemented or welded to the plate without destruction of the prisms.

The colored surfacing at 16 may actually be plural layers of differing colors; laminated by cementing on, or placed as insert material into the mold when plate 12 is formed.

Also the symbols may be provided as cut outs from appropriate sheet material, which are laid in the female block (plain bottomed) of the pair used for plate molding, especially in injection molding whereby the symbol elements are then bonded to the plate front face as it is formed.

Also the plate itself may be a large insert in a mold, in effect a mold face of one half of a total mold in which the symbols themselves are injection molded onto and so bonded on the front face of the plate.

The previously mentioned grid or screen pattern of dots may be imprinted on the flat front face of a plate 12, especially before the symbols are formed or applied.

I claim:

1. For manufacture of a reflector plate comprised of a light transmission synthetic plastic plate body, having a viewed front side and having integral, optically-precision-formed reflecting prisms distributed over its back side, a reflective metallic layer applied on the back side over the prisms, said reflector plate having one or more symbols delineated on its viewed front side by plate material displaced above or below the front surface of the body;

a method comprising the steps of:

preparing said body plate, with said reflecting prisms integral and evenly distributed thereon, from a light-transmissive and impact-resistant synthetic plastic;

thereafter applying a reflective metallic coating over the prisms on the back side of the body plate; and thereafter delineating at least one symbol in a form visible from the front of the reflector plate, by offsetting the symbol from the front face surface of the plate body with conventional stamping tooling, and simultaneously differentiating behind-symbol area on the back of the plate body from the rest of the back area by obliterating prisms thereof by pressing them flat on one of said areas.

2. A method as described in claim 1, including the further step of applying a protective layer to the reflective layer covered back side of the body plate.

3. A method as described in claim 1, wherein the elevated front face of a delineating area raised into relief from the front surface of the body plate is lacquer coated by means of a roller in an opaque dark color.

4. A method as described in claim 1, wherein the front surface of the reflector plate body over its entire area is covered with a colored layer comprised of lacquer, film or synthetic plastic, before symbol delineation;

the symbol is raised into relief from the front surface of the body plate; and finally the applied color layer is ground off the elevated face of the symbol.

* * * * *